US012522415B2

(12) United States Patent
Jesberg et al.

(10) Patent No.: US 12,522,415 B2
(45) Date of Patent: Jan. 13, 2026

(54) COSMETIC CONTAINERS, IN PARTICULAR A MASCARA CONTAINER

(71) Applicant: Seidel GmbH & Co. KG, Marburg (DE)

(72) Inventors: Silke Jesberg, Wetter (DE); Andreas Ritzenhoff, Marburg (DE); Michael Kurz, Neustadt-Speckswinkel (DE)

(73) Assignee: Seidel GmbH & Co. KG, Marburg (DE)

( * ) Notice: Subject to any disclaimer, the term of this patent is extended or adjusted under 35 U.S.C. 154(b) by 469 days.

(21) Appl. No.: 17/337,025

(22) Filed: Jun. 2, 2021

(65) Prior Publication Data

US 2022/0000248 A1 Jan. 6, 2022

(30) Foreign Application Priority Data

Jun. 2, 2020 (DE) ..... 10 2020 114 652.3

(51) Int. Cl.
*B65D 77/04* (2006.01)
*A45D 34/04* (2006.01)
(Continued)

(52) U.S. Cl.
CPC ..... *B65D 77/0486* (2013.01); *A45D 34/046* (2013.01); *A45D 40/0068* (2013.01);
(Continued)

(58) Field of Classification Search
CPC .... A45D 34/046; A45D 40/267; A45D 33/22; A45D 2034/007; A45D 34/047;
(Continued)

(56) References Cited

U.S. PATENT DOCUMENTS 4,175,008 A * 11/1979 White ..... C12M 33/02 206/209
4,289,248 A * 9/1981 Lynn ..... B65D 41/0471 215/331
(Continued)

FOREIGN PATENT DOCUMENTS

CN 109567364 A 4/2019
CN 111248604 A * 6/2020 ..... A45D 40/00
(Continued)

OTHER PUBLICATIONS

Chen, "CN111248604_Translated" (Year: 2020).*
Mathiez Jean Louis, "FR_2930475_A1_I_translated" (Year: 2009).*

*Primary Examiner* — Thomas C Barrett
*Assistant Examiner* — Holly T. To
(74) *Attorney, Agent, or Firm* — Dickinson Wright PLLC; Andrew D. Dorisio; Nicholas P. Coleman

(57) ABSTRACT

The invention relates to a cosmetics container, in particular a mascara container (400), whose components are a container part (401), a container cap (402), a wiper, which is inserted into a container neck disposed on a container part, and an applicator (403), which is connected to the container cap and passes through the wiper with a brush rod provided with an applicator brush on its free end. The wiper is made of a plastic material in contrast to at least one of the other previously mentioned components, material intersections, which are realised as detachable form-fit, detachable substance-to-substance or detachable force-fit connections, being formed least partially between the different materials for separation purposes.

15 Claims, 21 Drawing Sheets

(51) Int. Cl.

| | |
|---|---|
| ***A45D 40/00*** | (2006.01) |
| ***A45D 40/26*** | (2006.01) |
| ***A46B 9/02*** | (2006.01) |
| ***A46B 15/00*** | (2006.01) |
| ***B65D 41/04*** | (2006.01) |
| ***B65D 41/62*** | (2006.01) |

(52) U.S. Cl.
CPC ..... *A45D 40/267* (2013.01); *A46B 9/021* (2013.01); *A46B 15/0095* (2013.01); *B65D 41/045* (2013.01); *B65D 41/0478* (2013.01); *B65D 41/62* (2013.01); *A46B 2200/1053* (2013.01); *B65D 2251/0015* (2013.01); *B65D 2251/0078* (2013.01); *B65D 2251/20* (2013.01)

(58) Field of Classification Search
CPC ... A46B 9/021; A46B 2200/1053; A46B 3/08; A46B 5/00; A46B 2200/1046; A61B 15/0095
USPC ..... 132/218
See application file for complete search history.

(56) References Cited

U.S. PATENT DOCUMENTS 4,433,928 A * 2/1984 Kingsford ..... B65D 51/32 401/5
4,470,425 A * 9/1984 Gueret ..... A46D 1/00 401/122
4,705,053 A * 11/1987 Goncalves ..... A45D 40/268 401/122
6,343,887 B1 * 2/2002 Dumler ..... A46B 7/04 401/122
6,450,178 B1 * 9/2002 Clay ..... A45D 40/265 132/218
7,278,798 B1 * 10/2007 Kearney ..... A45D 40/267 401/121
7,686,528 B2 * 3/2010 Gueret ..... A45D 40/265 401/129
7,866,327 B1 * 1/2011 Gueret ..... A45D 34/046 132/218
7,997,285 B2 * 8/2011 Fischer ..... A45D 33/18 132/218
8,251,074 B2 * 8/2012 Pires ..... A46B 9/005 132/218
8,292,529 B2 * 10/2012 Francavilla ..... A45D 34/043 401/175
8,684,615 B2 * 4/2014 Lecoutre ..... A45D 40/267 401/122
8,882,381 B2 * 11/2014 Nobles ..... A45D 40/18 401/129
8,998,522 B2 * 4/2015 Gueret ..... A46B 9/021 401/129
9,033,605 B2 * 5/2015 Gueret ..... A46B 9/021 401/129
10,448,726 B2 * 10/2019 Lin ..... A45D 34/046
10,537,164 B1 * 1/2020 Chung ..... A45D 34/046
10,568,405 B2 * 2/2020 DeSimone ..... A46B 9/021
10,881,187 B2 * 1/2021 Jeong ..... A45D 40/267
11,006,727 B2 * 5/2021 Crapet ..... A45D 34/043
11,357,310 B2 * 6/2022 Nestor ..... A45D 40/265
2002/0168214 A1 * 11/2002 Carullo ..... A45D 40/265 401/6
2003/0034322 A1 * 2/2003 Doherty ..... B65D 41/0485 215/277
2003/0098036 A1 * 5/2003 Chan ..... A45D 40/267 132/320
2004/0234321 A1 * 11/2004 Breidenbach ..... A45D 34/06 401/17
2004/0234323 A1 * 11/2004 Albisetti ..... A45D 40/26 401/126
2005/0000849 A1 * 1/2005 Shih ..... A45D 40/265 206/823
2005/0249538 A1 * 11/2005 Patel ..... B43K 23/008 401/126
2008/0138138 A1 * 6/2008 Gueret ..... A46B 15/0091 401/23
2009/0032046 A1 * 2/2009 Gueret ..... A45D 40/267 15/160
2009/0065019 A1 * 3/2009 Salciarini ..... A45D 40/267 401/121
2009/0214285 A1 * 8/2009 Cho ..... A45D 40/24 401/129
2011/0309083 A1 * 12/2011 Hsiu-Tzu Charlene ..... A45D 34/00 206/459.5
2012/0020720 A1 * 1/2012 L'Abbate ..... A45D 40/265 401/129
2012/0195672 A1 * 8/2012 Chan ..... A45D 40/265 401/129
2012/0282010 A1 * 11/2012 Albers ..... A46B 11/0041 220/259.3
2013/0101333 A1 * 4/2013 Ornoski ..... A45D 40/267 401/122
2014/0147189 A1 * 5/2014 Wightman ..... A45D 34/046 401/122
2014/0205358 A1 * 7/2014 Pschirer ..... A45D 40/262 401/126
2014/0290681 A1 * 10/2014 Pires ..... A45D 34/046 401/121
2014/0301764 A1 * 10/2014 Eberlein ..... A45D 34/046 401/122
2015/0053233 A1 * 2/2015 Lim ..... A45D 40/18 132/218
2015/0182003 A1 * 7/2015 Neuner ..... B65D 51/32 401/122
2016/0081453 A1 * 3/2016 Wightman ..... A45D 42/02 132/200
2017/0088305 A1 * 3/2017 Jacob ..... B65D 1/0246
2017/0088314 A1 * 3/2017 Jacob ..... A45D 40/267
2017/0088315 A1 * 3/2017 Jacob ..... B65D 41/0407
2017/0127802 A1 * 5/2017 Chen ..... A45D 40/265
2017/0265618 A1 * 9/2017 Eberlein ..... A45D 34/045
2018/0000227 A1 * 1/2018 Crapet ..... A45D 34/046
2018/0055194 A1 * 3/2018 Arredondo ..... A45D 34/046
2018/0055205 A1 * 3/2018 Pires ..... A45D 40/267
2018/0317630 A1 * 11/2018 Chen ..... A45D 34/045
2019/0133295 A1 * 5/2019 Moretti ..... A45D 40/267
2020/0237087 A1 * 7/2020 Gunness ..... A46B 9/021
2021/0204675 A1 * 7/2021 Maddox ..... A45D 40/267
2022/0039539 A1 * 2/2022 Cattani ..... A45D 40/267
2022/0055315 A1 * 2/2022 Villarreal ..... B29C 66/1122
2022/0142331 A1 * 5/2022 Hasegawa ..... A45D 40/265
2022/0346527 A1 * 11/2022 Mecca ..... A45D 34/047
2022/0378174 A1 * 12/2022 Jesberg ..... A46B 11/0079
2023/0092191 A1 * 3/2023 Lin ..... A45D 34/046 401/129
2023/0115972 A1 * 4/2023 DeAngelo ..... A45D 40/265 132/314
2025/0031831 A1 * 1/2025 Volatier ..... A45D 34/043

FOREIGN PATENT DOCUMENTS

DE 8907317 U1 8/1989
DE 202014105838 U1 * 4/2016 ..... A45D 40/267
DE 202017100438 U1 2/2017
EP 227147 A1 7/1987
EP 2271474 B1 5/2017
FR 2930475 A1 * 10/2009 ..... A45D 40/0068
WO WO-0192116 A2 * 12/2001 ..... B65D 45/322
WO WO-03015567 A1 * 2/2003 ..... A45D 40/264
WO WO-2017053661 A1 * 3/2017 ..... A45D 40/262
WO WO-2018122472 A1 * 7/2018
WO WO-2023247892 A1 * 12/2023
WO WO-2024087505 A1 * 5/2024

* cited by examiner

COSMETIC CONTAINERS, IN PARTICULAR A MASCARA CONTAINER

TECHNICAL FIELD

The invention relates to a cosmetics container, in particular a mascara container, whose components are a container part, a container cap, a wiper, which is inserted into a container neck disposed on a container part, and an applicator, which is connected to the container cap and passes through the wiper with a brush rod provided with an applicator brush on its free end.

BACKGROUND

Cosmetics containers of the type mentioned above are commonly realised as material hybrids, which means that the cosmetics containers made of a plurality of components comprise components which consist of different materials. The cosmetics containers mentioned above are mostly made of material hybrids or material mixes made of aluminium and plastic, meaning an effective recycling presumes separating the materials in particular in the case when the respective material portion exceeds a certain range. Separating the materials is often time-consuming, in particular when separating the materials cannot be carried out economically means sacrificing the inferior or less valuable material to enable recycling the more valuable material portion. This can occur, for example, when cosmetics containers, which have aluminium and plastic components, are molten for recycling purposes so that the material is separated in this case by burning or gasifying the plastic portion.

An extensive recycling of a cosmetics container made of several components becomes possible using two different approaches, for example, the cosmetics container of the first approach being designed such that the individual components can be easily separated from each other, while the second approach strives for a plastic portion as small as possible to limit the non-recyclable portion of the cosmetics container to a minimum when sacrificing plastic material.

SUMMARY

The object of the present invention is therefore to propose a cosmetics container which enables a simplified recycling of the used materials and is distinguished by a particularly high portion of recyclable materials.

According to the invention, material intersections are formed at least partially in the cosmetics container, whose wiper is made of a plastic material in contrast to at least one of the other previously mentioned components, between the different materials or components for separation purposes, the material intersections being realised as detachable form-fit, detachable substance-to-substance or detachable force-fit connections so that the cosmetics container according to the invention does not have to supplied to the recycling process as a whole unit, but instead the components can be separated before recycling takes place owing to the material intersections for the subsequent supply of the components to the different recycling methods or non-recyclable materials or materials which can only be recycled with great effort can be separated from the materials which are comparatively better suited for recycling.

The wiper can be made not only of plastic but also of a material deviating from the material used for the other components.

The cosmetics container according to the invention also makes it possible to reduce the plastic portion to a range as small possible, e.g., less than 10%, and to choose a uniform recycling method for the other components, in particular in the case when these materials consist of a uniform material, such as in particular aluminium.

In any case, the cosmetics container according to the invention consequently simplifies recycling the cosmetics container.

It is particularly advantageous if the container cap comprises a cap outer part and a cap inner part, which each comprise a sleeve part, the two sleeve parts being connected to each other via a press-fit connection, an adhesive connection or a welding connection. Differentiating between a cap outer part and a cap inner part enables using different materials, if required, for the cap outer part and the cap inner part while also forming a suitable detachable material intersection between the sleeve parts to enable an overall high portion of a recyclable material of the container cap.

If the applicator is held in the cap inner part by means of an applicator holder, an intersection, which enables separating the applicator from the container cap or the cap inner part particularly easily, can be defined by the applicator holder.

Preferably, the applicator holder comprises a connective area for being connected to the cap inner part so that separating the applicator holder and the cap inner part is also possible.

If the connective area is pressed into a receiving area of the cap inner part, a mechanical separation of the components can be carried out particularly easily by applying the corresponding separating forces.

Preferably, the applicator holder comprises a joining area having a sleeve-shaped joining end for being connected to the brush rod, so that the connection between the applicator holder and the applicator is defined for a simple material separation.

Preferably, the joining end is connected to the joining area by means of a clamp connection, so that comparatively low separation forces are sufficient for separating the applicator from the applicator holder.

It is particularly advantageous if the container part comprises a container body having the moulded-on container neck for receiving the wiper and a container bottom formed independently of the container body, so that complex container embodiments are also possible in particular with regard to its shape, without being dependent on choosing materials, which can be formed as easily as possible, such as a thermoplastic which can be processed in an injection moulding process, for producing the cosmetics container or the container part. Indeed, it is possible to choose more valuable materials, such as aluminium, for the container part, without there being any restrictions regarding the shape of the container part.

If the wiper is made of an elastically deformable plastic material such that the wiper is axially fixated in the container neck by two locking ridges, which are formed on an axial end of the wiper, one of the locking ridges abutting against an opening edge of a container opening of the container neck from the outside and the other locking ridge engaging behind a container shoulder formed in a cross over area from the container neck to the container body, the container part or at least the container neck can be made of a differing material, such as in particular aluminium, without further difficulty and without any particular effort for separating the materials as a prerequisite for a subsequent recycling method being required. Rather, the wiper and the container neck can be connected via suitable deformation of the wiper.

It is also particularly advantageous if the container bottom is cup-shaped and has an expanded cross section, which is formed on an opening edge of a cup wall, with respect to a cup base, the expanded cross section corresponding in size to the inner diameter of the container body or being slightly larger, so that the container bottom can be easily separated mechanically from the container by the container bottom, which is pressed into the container body for production of the container part, only having to be pushed or pulled out of the container body.

If, moreover, the container body comprises a bottom opening having an opening edge, which protrudes radially inward, the diameter of the bottom opening defined by the opening edge corresponding in size to the outer diameter of the bottom base or being slightly larger, the advantageous connection described above between the container bottom and the container body of the container part can be made possible, without bringing with it a disadvantageous aesthetic effect to the outer appearance of the container part. Indeed, the opening edge protruding inward can reduce or even compensate a ring gap, which is located between the bottom base or the cup wall of the container bottom and the wall of the container body and is required for the joining process, following the joining process via a deformation of the opening edge directed radially inward so that essentially no ring gap can be seen in the outer appearance of the container part when viewing the container bottom from below.

It is also particularly advantageous if the cap inner part is connected to the cap outer part by means of a cap insert disposed between the sleeve part of the cap inner part and the sleeve part of the cap outer part so that the cap insert constitutes a mechanical connective element between the cap inner part and the cap outer part.

If the cap inner part is designed as an applicator holder, the cap inner part can be assigned a double function so that an applicator holder becomes redundant as an autonomous component of the cosmetic container and consequently no set of problems arises regarding recycling of the applicator holder, in particular in the event if the cap inner part and the cap outer part are made of the same material, in particular aluminium.

Preferably, the cap inner part comprises a receiving opening in a bottom for an axial connective protrusion formed on the end of the brush rod, such that a projection of the connective protrusion protruding over an opening edge of the receiving opening engages behind the opening edge after deformation.

It is thus possible to connect a brush rod made of a plastic material to a cap inner part, which is made of aluminium and at the same forms the applicator holder, to each other via an ultrasonic welding method, so that only the material portion of the brush rod forming the projection of the connective protrusion has to be separated and, if applicable, sacrificed for a material separation before a recycling method.

If the container part comprises a container body, which is provided with a bottom and which comprises a receiving opening on its end opposite the bottom for receiving a container neck formed independently of the container body, another option exists for creating a container part which has an overall complex design, without necessarily having to switch to a plastic material to create a container part which is recyclable in its entirety. Indeed, it is possible to produce both the container body and the container neck from the same valuable recycling material, such as aluminium.

Preferably, the container neck is inserted in such a manner into the receiving opening by a connective end, whose outer diameter corresponds in size to the inner diameter of the container body, that a shoulder formed in the cross over area to a thread part of the container neck is disposed so as to be flush with an opening edge of the receiving opening. Thus, a container part is enabled, which is particularly advantageous with regard to a recycling method and at the same time fulfils the highest aesthetic requirements to its outer appearance.

If a wiper made of a shape-elastic plastic is inserted into the thread part of the container neck, an edge web, which protrudes radially inward on an opening edge of the thread part, engaging into a locking groove formed on the wiper and a radial edge web of the wiper, which is formed adjacent to the locking groove, axially protruding over the opening edge, separating the materials is possible particularly easily when using different materials for the container neck and the wiper, i.e., the shape-elastic plastic material for the wiper and preferably aluminium for the container part.

It is particularly advantageous regarding a simple separation of materials, if a joining end of the brush rod is connected to the applicator holder by means of a bayonet joint.

Independently of a set of problems regarding recycling, a bayonet joint between an applicator holder and an applicator for a cosmetics container, which is provided with an applicator and is realised as a mascara container, is advantageous as an applicator can be easily exchanged. This advantage of course exists independently of whether the components of the container are made of different or the same material. In the case of a mascara container, the wiper can therefore be made of any arbitrary material, as long as the wiper fulfils its function.

Preferably for this purpose, the applicator holder comprises a cup-shaped receiving part for receiving the joining end having a connective protrusion formed on a cup bottom, such that a projection of the connective protrusion, which protrudes over an opening edge of a receiving opening formed in the cap bottom of the cap inner part, engages behind the opening edge after deformation in order to be connected to the cap inner part, so that a formation can take place via an ultrasonic welding process, with the result that for separating the applicator holder from the cap inner part, merely the material projection needs to be separated.

If the joining end of the brush rod comprises two radially protruding pins, which are disposed at a distance a axially from a stop collar and serve for engaging in a locking groove each, the locking grooves each being formed in a cup wall of the applicator holder at a distance a to a cup edge, the bayonet joint can be realised using particularly little material.

Preferably, the stop collar simultaneously serves for the sealing abutment against an opening edge of an opening formed for passing the brush rod through the wiper, so that a separate seal need not be provided.

If the wiper comprises a stop collar in an axial end of a sleeve inserted into the container neck for the outer abutment against an opening edge of the container neck and comprises several fastening tabs, which are dispersed across the circumference of a sleeve edge on opposite axial ends of the sleeve and engage behind an inner shoulder, which is formed on the container neck, when deformed radially outward, a material connection between the wiper and the container neck which can be detached particularly easily can be realised.

BRIEF DESCRIPTION OF THE DRAWINGS

Advantageous embodiments of the cosmetics container are described in further detail using the drawings.

DETAILED DESCRIPTION

Figure 1:
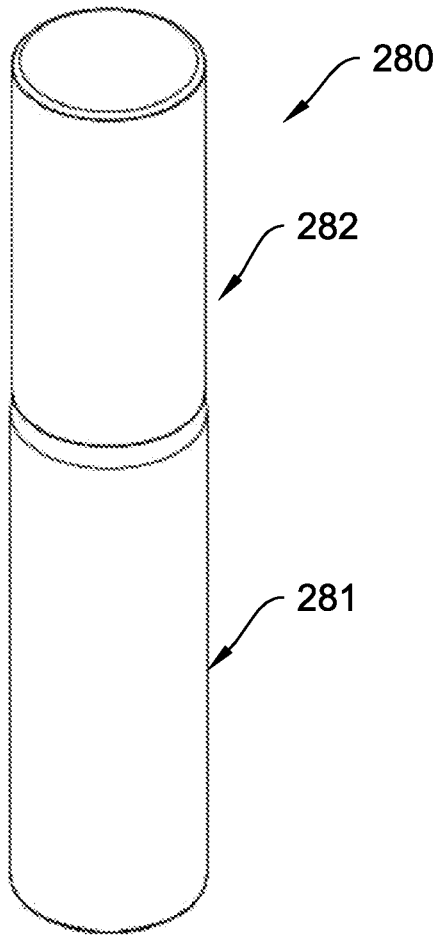
FIG. 1 shows an isometric view of a cosmetics container according to a first embodiment.
Figure 2:
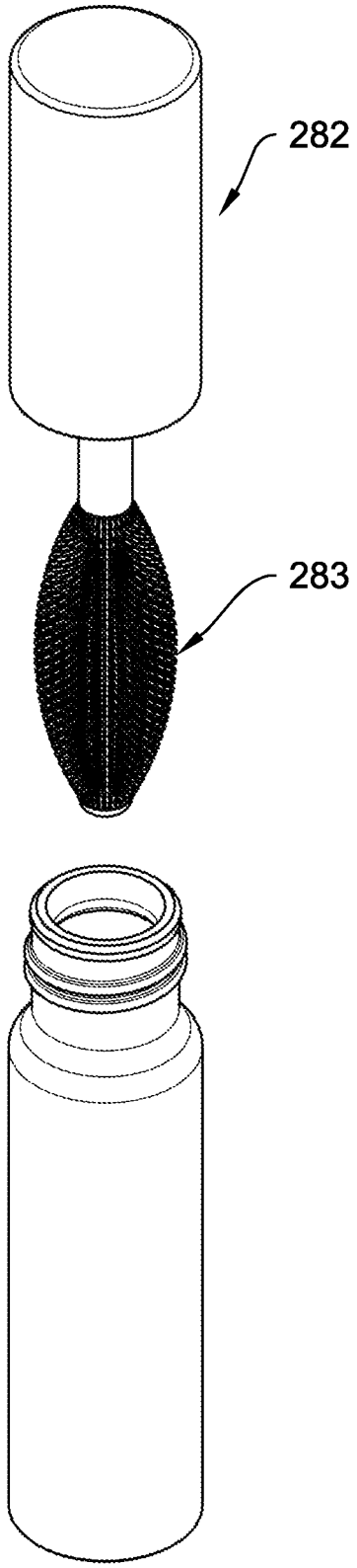
FIG. 2 shows the cosmetics container shown in FIG. 1 having an applicator removed from a container part.
Figure 3:
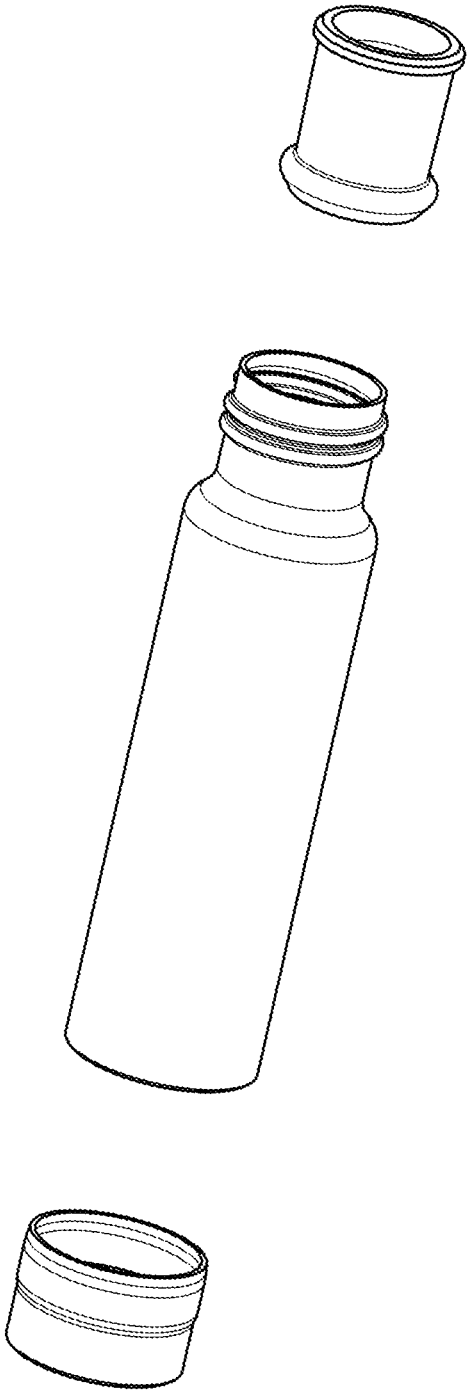
FIG. 3 shows an exploded view of the container part shown in FIG. 2.
Figure 4:
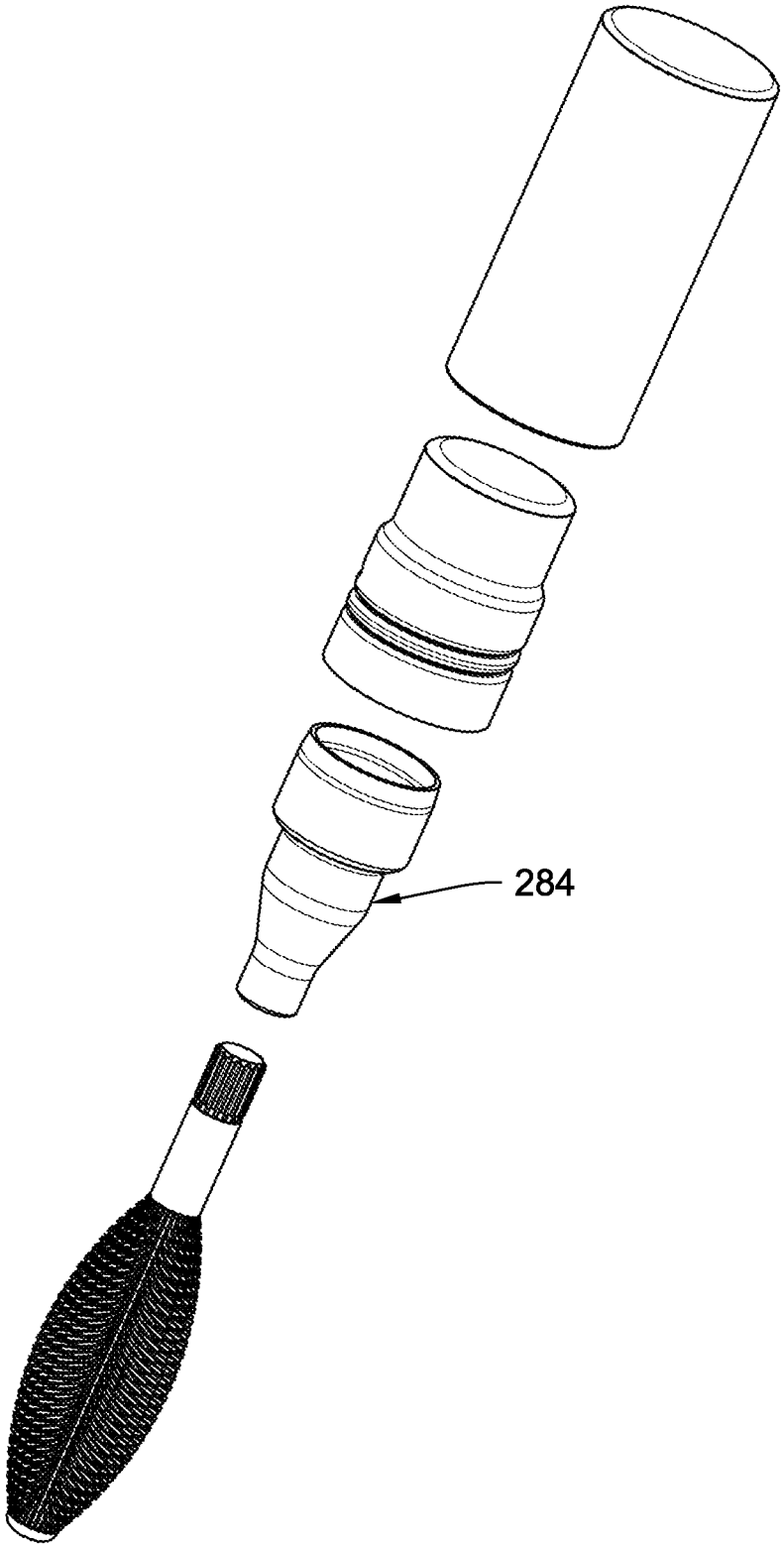
FIG. 4 shows the applicator shown in FIG. 2 connected to a container cap removed from the container part together with an exploded view of the container cap.
Figure 5:
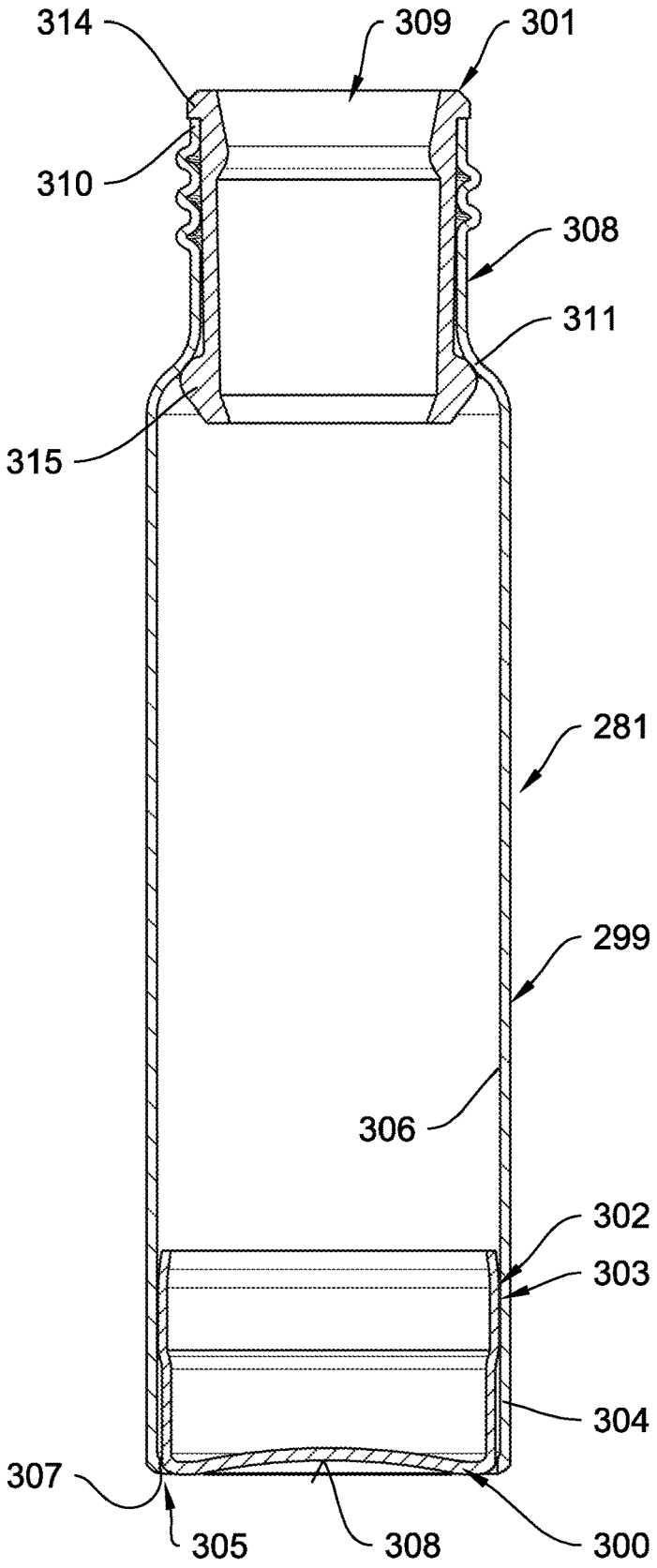
FIG. 5 shows a view of a longitudinal cut of the container part shown in FIG. 2.
Figure 6:
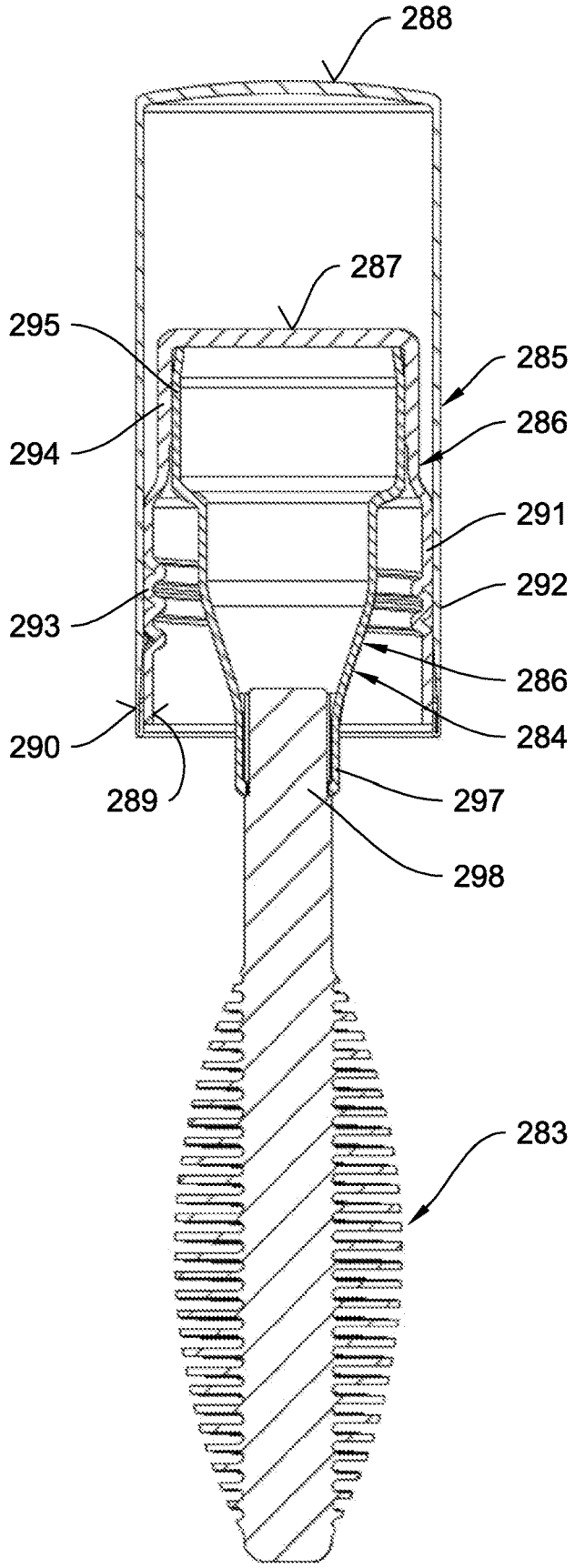
FIG. 6 shows a view of a longitudinal cut of the applicator shown in FIG. 2 while connected to the container cap.

FIGS. 1 to 7 show a mascara container 280, which comprises a container part 281 and a container cap 282. Container cap 282 is provided with an applicator 283, which is connected to a cap inner part 286, which is received in a cap outer part 285, via an applicator holder 284, as in particular a synopsis of FIGS. 4 to 6 shows.

As in particular FIG. 6 shows, both cap inner part 286 and cap outer part 285 are sleeve-shaped, cap inner part 286 and cap outer part 285 each comprising a cap bottom 287, 288 on an end and each comprising an opening edge 289 and 290 on opposite ends of cap bottoms 287, 288. Cap inner part 286 and cap outer part 285 each comprise a sleeve part 291 and 292, respectively, sleeve parts 291, 292 being connected to each other via a press-fit connection, an adhesive connection or a welding connection, the welding connection being realised preferably in the area of overlapping opening edges 289, 290.

Cap inner part 286 preferably pressed into cap outer part 285 comprises a cap thread 293 formed by deformation and a receiving area 294 formed adjacent to cap bottom 287 for being connected to a connective area 295 of applicator holder 284. Connective area 295 of applicator holder 284 is preferably pressed into receiving area 294 of cap inner part 286.

For being connected to applicator 283, applicator holder 284 comprises a joining area 286, which is designed to be tapered, and has a sleeve-shaped joining end 297, which is preferably connected to a joining end 298 of applicator 283 via a clamping connection.

All components of container cap 282, i.e., cap outer part 285, cap inner part 286 and applicator holder 284, are made of metal, preferably alumminium, whereas the applicator preferably consists of a plastic material.

As in particular shown in FIGS. 3 and 5, container part 281 comprises a container body 299, which is provided with a container bottom 300, which is cup-shaped in this instance, and a wiper 301, which is made of a deformable plastic material in contrast to container body 299 and container bottom 300, which are made of metal, preferably aluminium.

As in particular FIG. 5 shows, container bottom 300 is provided with a ridge-shaped expanded cross section 303 on an opening edge 302, expanded cross section 303 protruding radially outward with respect to a bottom base 304. On an end facing container bottom 300, container body 299 comprises a bottom opening 305 for receiving container bottom 300, container opening 305 comprising an opening edge 307 protruding radially inward from a jacket wall 306 of container body 299, the diameter of bottom opening 305 defined by opening edge 307 corresponding in size to the outer diameter of bottom base 304 and the outer diameter of expanded cross section 303 corresponding in size to the inner diameter of container body 299 or either being slightly larger.

For mounting container bottom 300 on container body 299, expanded cross section 303 of container bottom 300 is inserted so far into container body 299 via bottom opening 305 until a bottom wall 308 of bottom base 34 is essentially disposed so as to be flush with opening edge 307 of container body 299, as shown in FIG. 5. The special embodiment of container bottom 300 as described above leads to a clamping between expanded cross section 303 and jacket wall 306 and, if applicable, between bottom base 304 and opening edge 307 for a mechanical connection between container bottom 300 and container body 299, the clamping being able to be complemented by an adhesion or a solder if required, in particular in the area of expanded cross section 303.

Owing to its elastic design, wiper 301 can be inserted into container body 299 via a container opening 309 formed on a container neck 308, an axial fixation of the wiper in container neck 308 being made possible by two locking ridges 314, 315, which are each formed on an axial end of wiper 301 and which, on the one hand, abut against an opening edge 310 of container opening 309 and, on the other hand, engage behind a container shoulder 311 formed in the cross over area between container neck 308 and container body 299.

Figure 7:
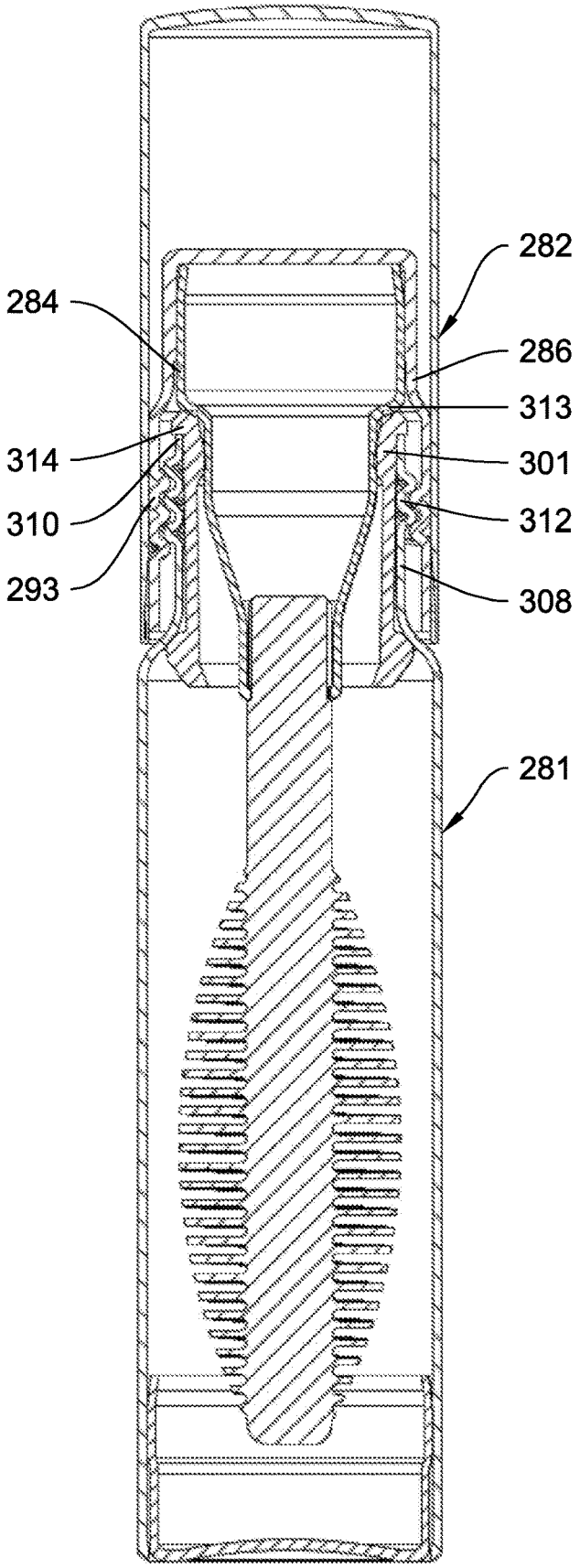
FIG. 7 shows a view of a longitudinal cut of the cosmetics container shown in FIG. 1.
Figure 8:
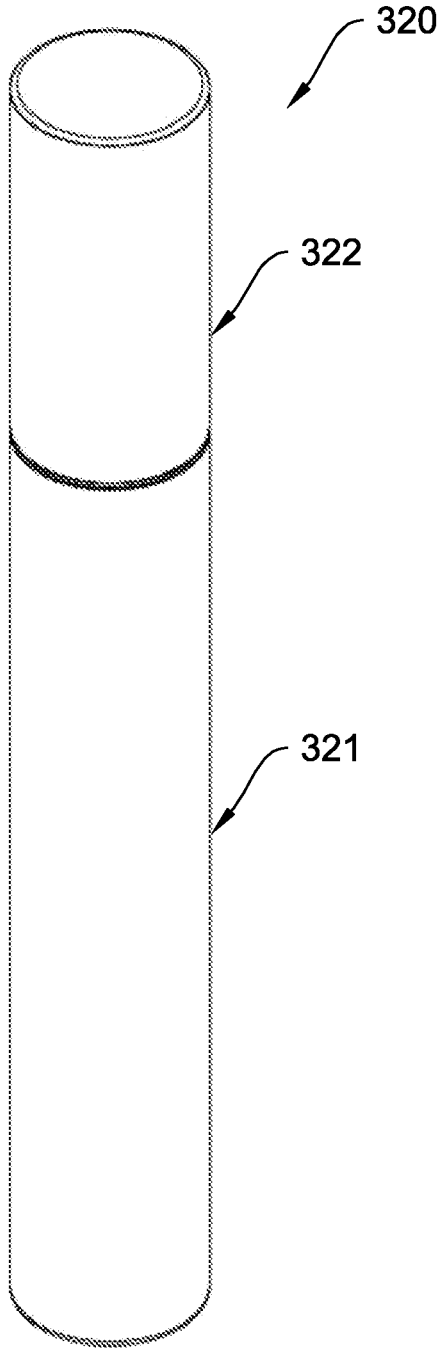
FIG. 8 shows an isometric view of a cosmetics container according to another embodiment.

As FIG. 7 shows, cap thread 293 formed in cap inner part 286 and a container-neck thread 312 formed on container neck 308 are screwed together to close container part 281 with container cap 282, a sealing abutment of an applicator shoulder 313 formed on applicator holder 284 being formed on wiper 301 in such a manner that upper edge ridge 314 of wiper 301 is disposed between opening edge 310 of container opening 309 and applicator holder 284.

Figure 9:
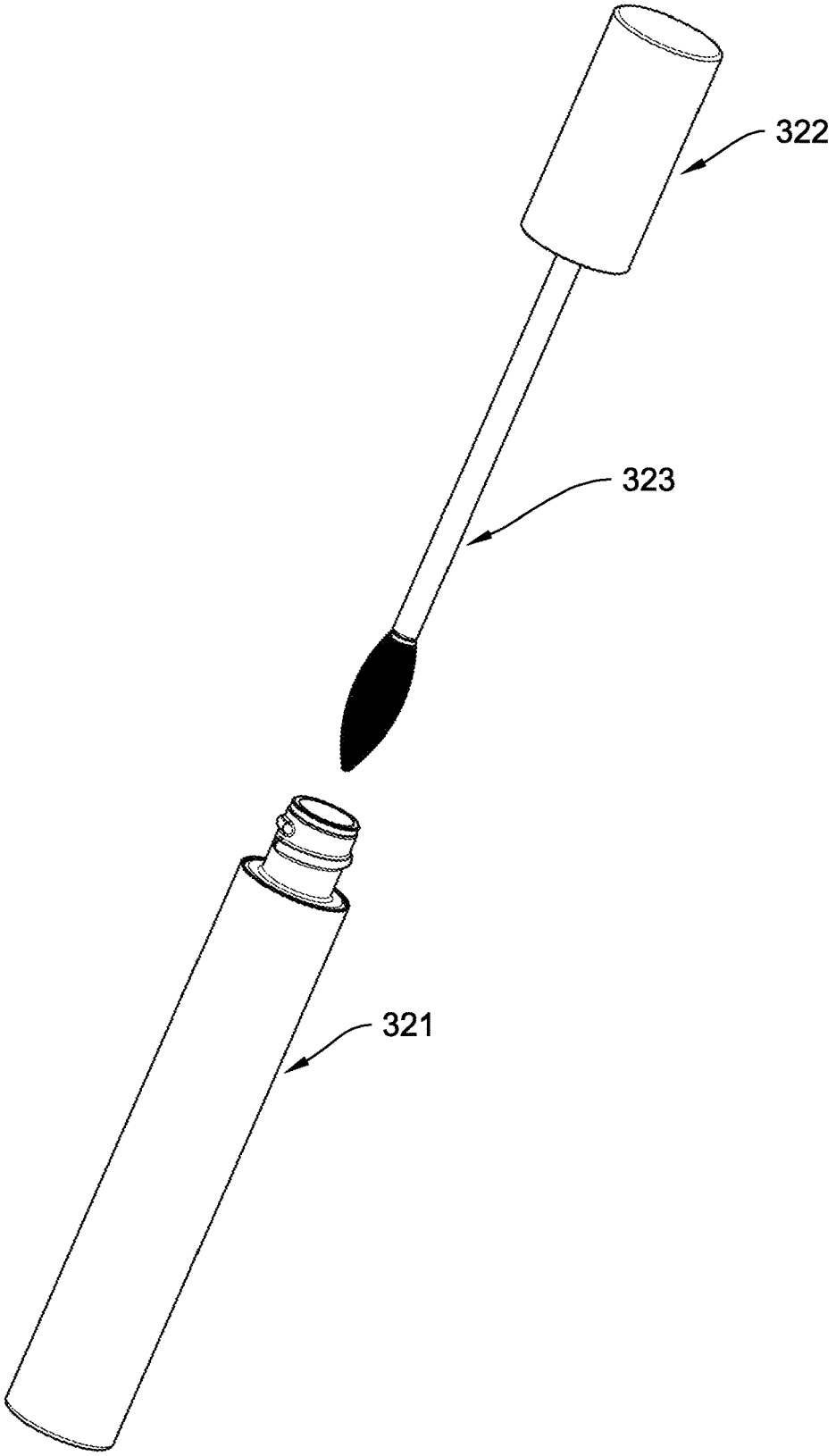
FIG. 9 shows the cosmetics container shown in FIG. 8 with an applicator removed from the container part.

FIGS. 8 to 14 show another embodiment of a mascara container 320 which, as in particular FIG. 9 shows, comprises a container part 321 and a container cap 322 provided with an applicator 323.

Figure 11:
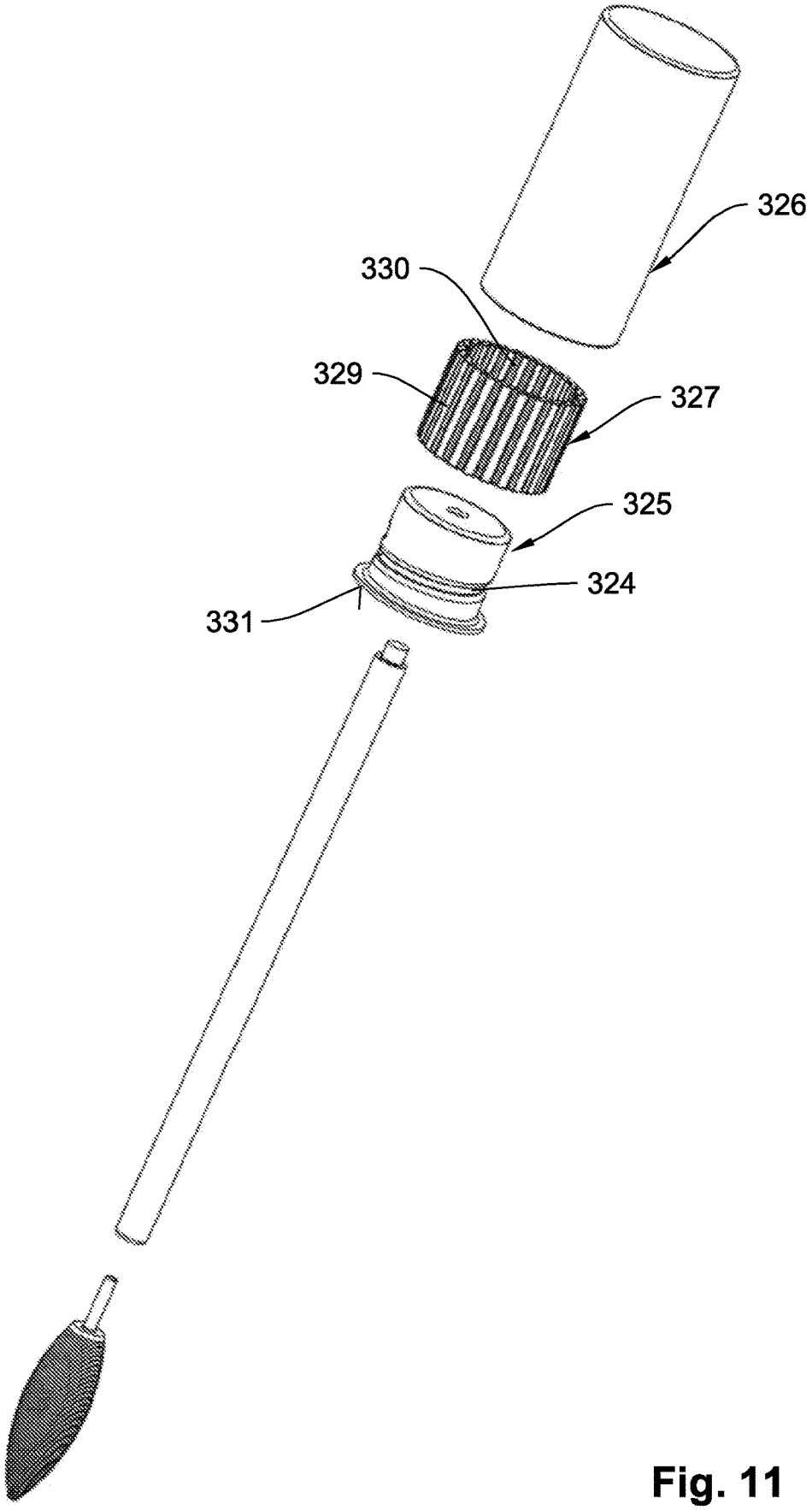
FIG. 11 shows an exploded view of the applicator shown in FIG. 9 while connected to the container cap.
Figure 13:
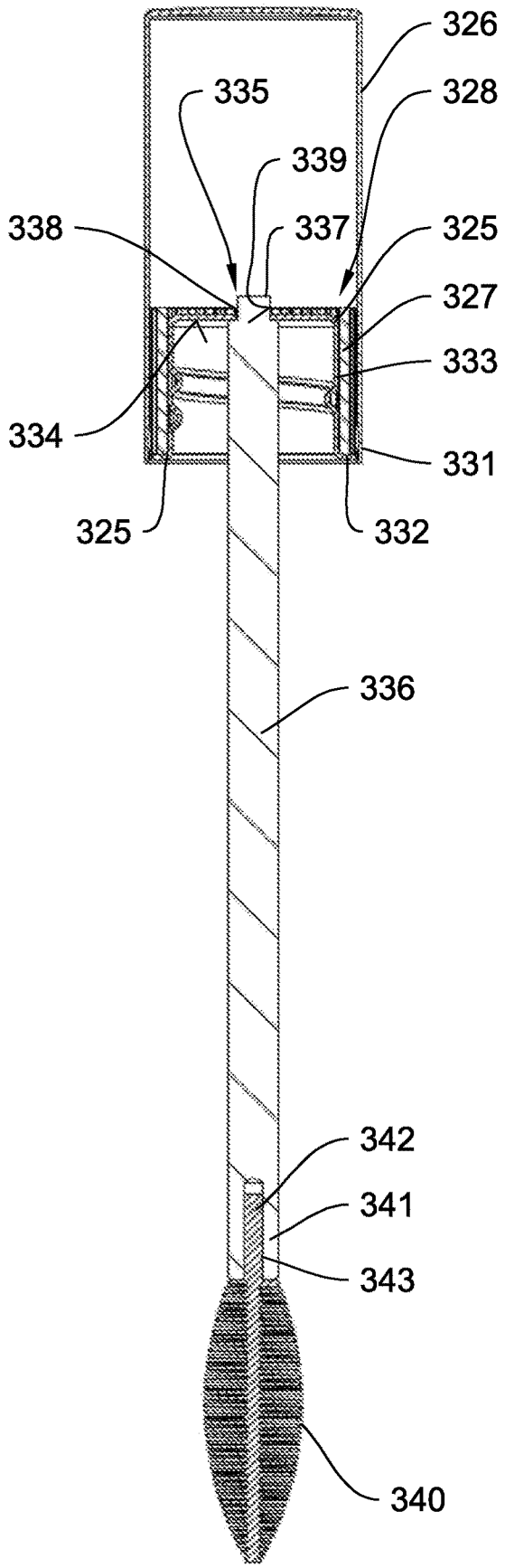
FIG. 13 shows a longitudinal cut of the applicator shown in FIG. 9 while connected to the container cap.

As in particular FIGS. 11 and 13 show, container cap 322 comprises a cap inner part 325 provided with a cap thread 324, a cap outer part 326 and a cap insert 327, which preferably forms a cap weight at the same time and which is disposed in an annular gap 328 formed between cap outer part 326 and cap inner part 325. Cap outer part 326 as well as cap inner part 325 and cap insert 327 consists of metal, preferably aluminium, the cap insert, as in particular shown in FIG. 11, being sleeve-shaped and comprising clamping webs 329, 330, which extend on the outer side and inner side of cap insert 327 in its longitudinal direction and which make possible a mechanical connection between cap outer part 326 and cap inner part 325 via a clamping when cap insert 327 is disposed in gap 328. In addition, it is possible to provide the outer side and the inner side of the cap insert with an adhesive layer, meaning that if required, cap inner part 325 can be glued to cap outer part 326 via cap insert 327.

Cap inner part 325 comprises a radial edge web 332, which is opposite an opening edge 331 of a receiving opening formed for receiving cap inner part 325 in cap outer part 326, such that edge web 332 can be connected, in particular glued or soldered, to the opening edge in a flush position.

As FIG. 13 shows, cap inner part 325 serves at the same time for forming an applicator holder 333, which comprises a receiving opening 335 in a bottom 334 of cap inner part 325 in the case at hand, an axial connective protrusion 337, which is formed on the connective end of a brush rod 336, being inserted into receiving opening 335 and, for example, being able to be connected to an opening edge 339 by deforming a projection 338 protruding backwardly from bottom 334.

As FIG. 13 further shows, a plastic applicator head 340 is connected to a receiving end 341, which is opposite the connective end of brush rod 336, a joining end 342 of plastic applicator head 340 preferably being received in a receiving bore 343 of brush rod 336 for this purpose.

Figure 10:
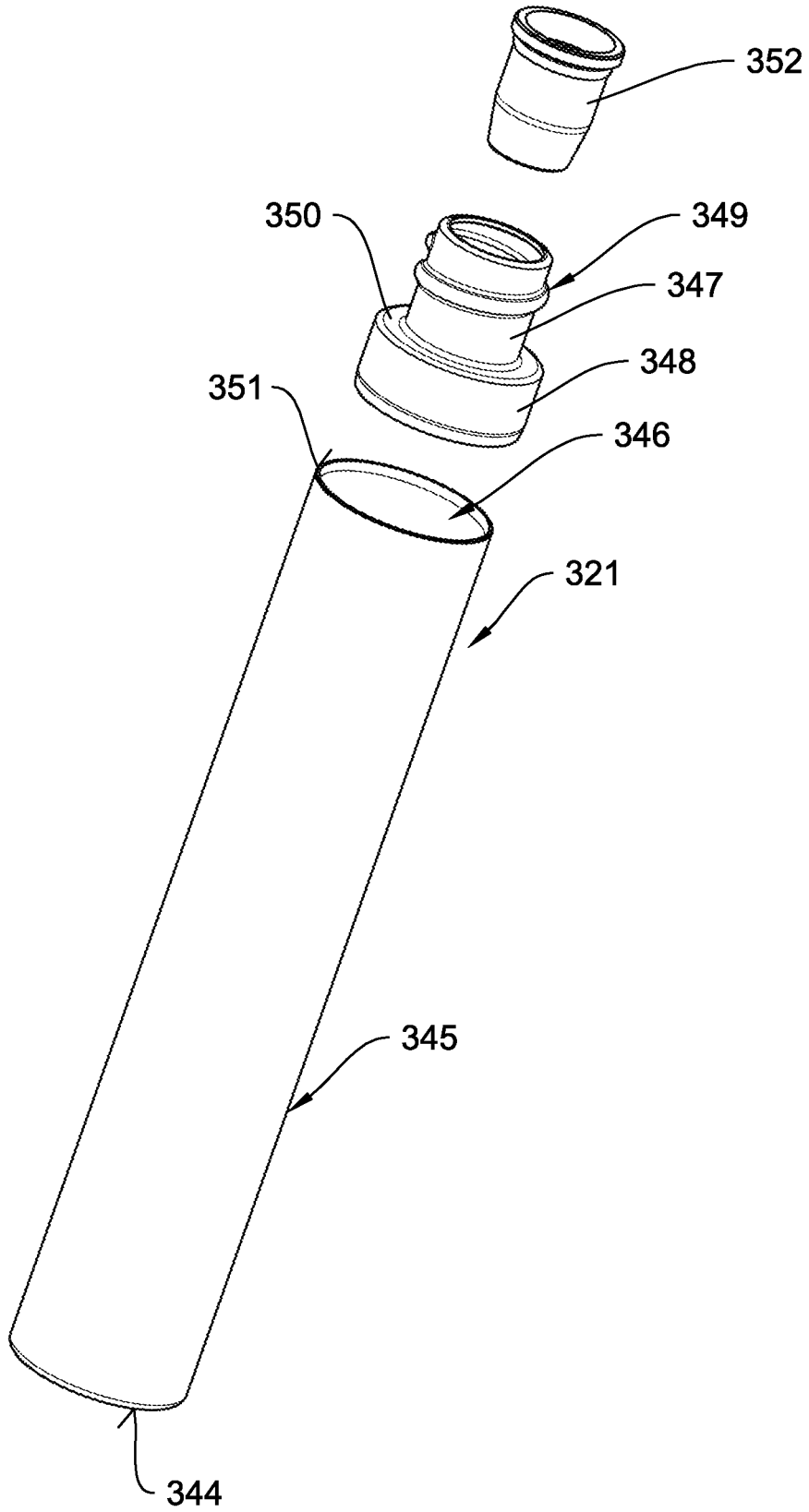
FIG. 10 shows an exploded view of the container part shown in FIG. 8.
Figure 12:
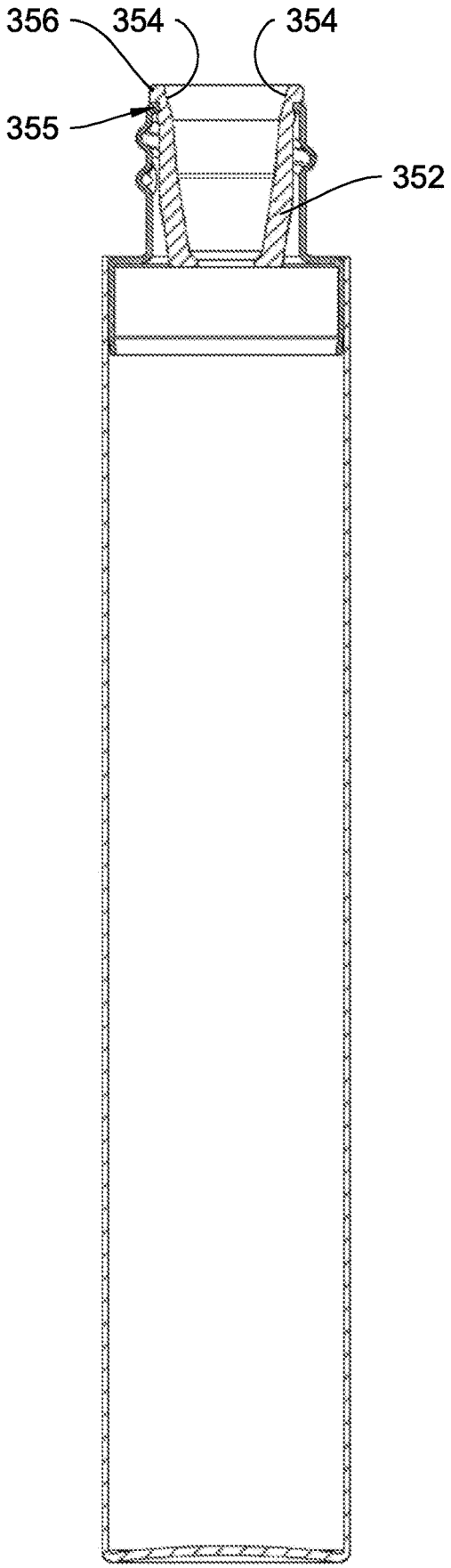
FIG. 12 shows a longitudinal cut of the container part of the cosmetics container shown in FIG. 8.

As in particular FIGS. 10 and 12 show, container part 321 comprises a container body 345, which is provided with a bottom 344 and comprises a receiving opening 346 on its end opposite bottom 344 for receiving a container neck 347. A connective end 348 of container neck 347, whose outer diameter corresponds to the inner diameter of container body 345, is inserted into receiving opening 346 in such a manner that a shoulder 350, which is formed in the cross over area to a thread extension 349 of container neck 347 is disposed so as to be flush with an opening edge 351 of receiving opening 346.

A wiper 352 made of a shape-elastic plastic is inserted in thread extension 349 of container neck 347, an edge web 354, which protrudes radially inward on an opening edge 353 of thread extension 349, engaging into a locking groove 355 formed on the wiper, a radial edge web 356 of wiper 352 formed adjacent to locking groove 355 axially protruding over opening edge 351. Alternatively thereto, a wiper can also be produced as an injection moulded part, which can be injected directly into a substance-to-substance connection for forming a substance-to-substance connection with container neck 347.

Figure 14:
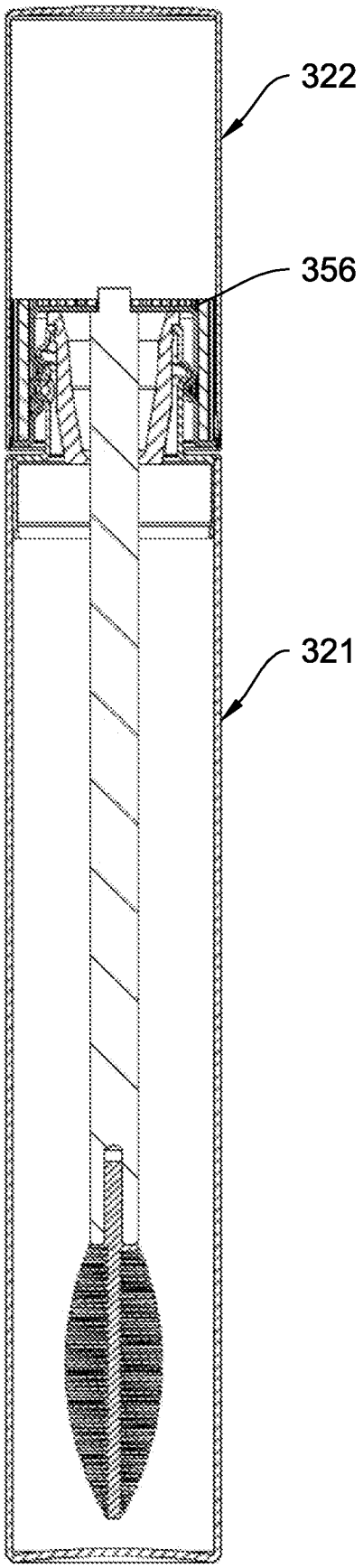
FIG. 14 shows a view of a longitudinal cut of the cosmetics container shown in FIG. 8.

As FIG. 14 shows, edge web 356 forms a seal between container part 321 and container cap 322 in such a manner when a container part 321 is sealed by container cap 322 that edge web 356 is disposed between opening edge 351 of container part 321 and bottom 334 of cap inner part 325 in a sealing manner.

Figure 15:
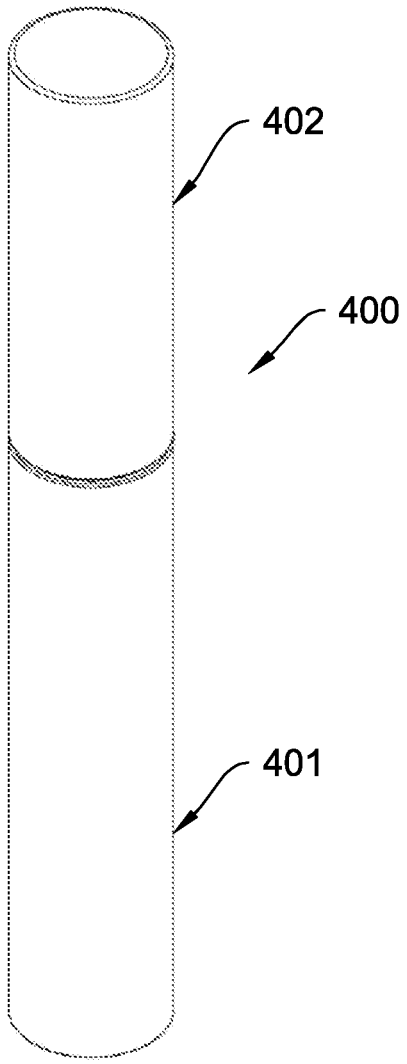
FIG. 15 shows an isometric view of another embodiment of a cosmetics container.
Figure 16:
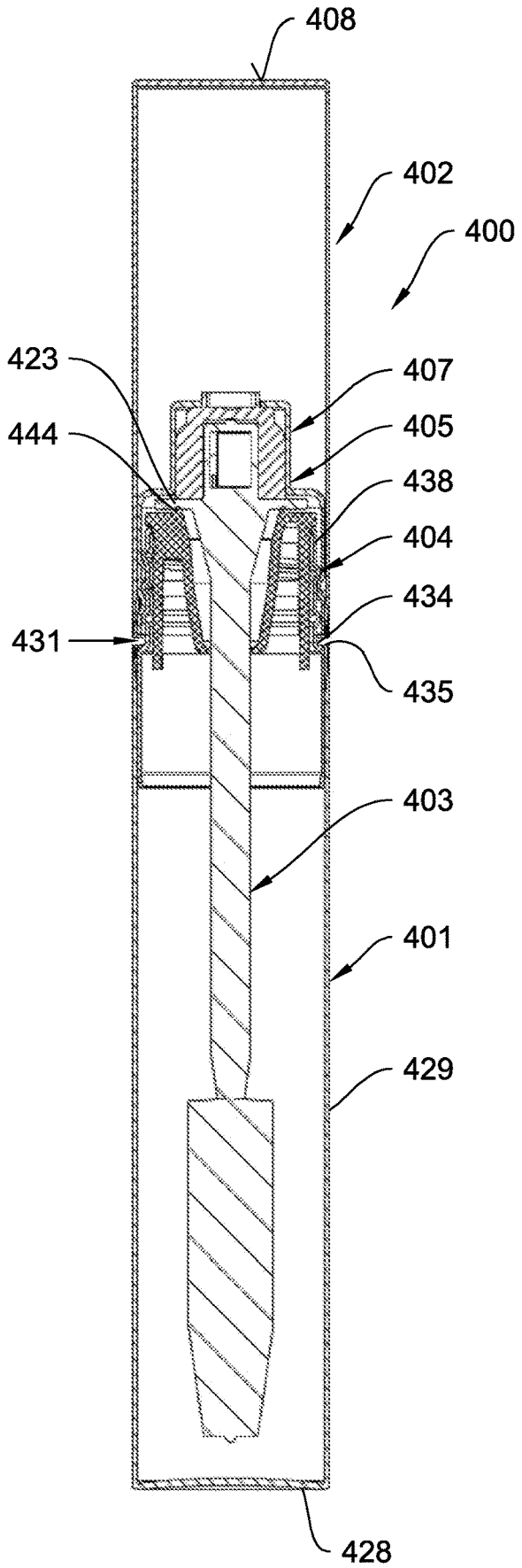
FIG. 16 shows a longitudinal cut of the cosmetics container shown in FIG. 15.

In FIGS. 15 to 21, another embodiment of a mascara container 400 is shown which, as in particular FIGS. 15 and 16 show, comprises a container part 401 and a container cap 402 provided with an applicator 403.

As FIG. 16 shows, container cap 402 comprises a cap inner part 404 provided with a cap thread 404 and a cap outer part 406, both cap inner part 405 and cap outer part 406 being sleeve-shaped and each comprising a cap bottom 407, 408 on one end and each comprising an opening edge 409, 410, which are disposed on opposite ends of cap bottoms 407, 408 and between which a connection is produced, which can be realized as a press-fit connection, an adhesive connection or a welding connection.

As in particular a synopsis of FIGS. 18 to 21 clearly shows, applicator 403 comprises a brush rod 411 whose joining end 412 is connected to an applicator holder 414 by means of a bayonet joint 413, applicator holder 414 being received in a recess 415 formed in cap bottom 407 of cap inner part 405.

Applicator holder 414 comprises a cup-shaped receiving part 416 (FIG. 19) for receiving joining end 412 with a connective protrusion 417 formed on a cup bottom, a projection 420 of connective protrusion 417, which protrudes over an opening edge 418 of a receiving opening 419 formed in cap bottom 407 of cap inner part 405, engaging behind opening edge 418 after a deformation which is not illustrated and preferably takes place by means of an ultrasonic welding tool in order to connect applicator holder 414 to cap inner part 405.

Figure 20:
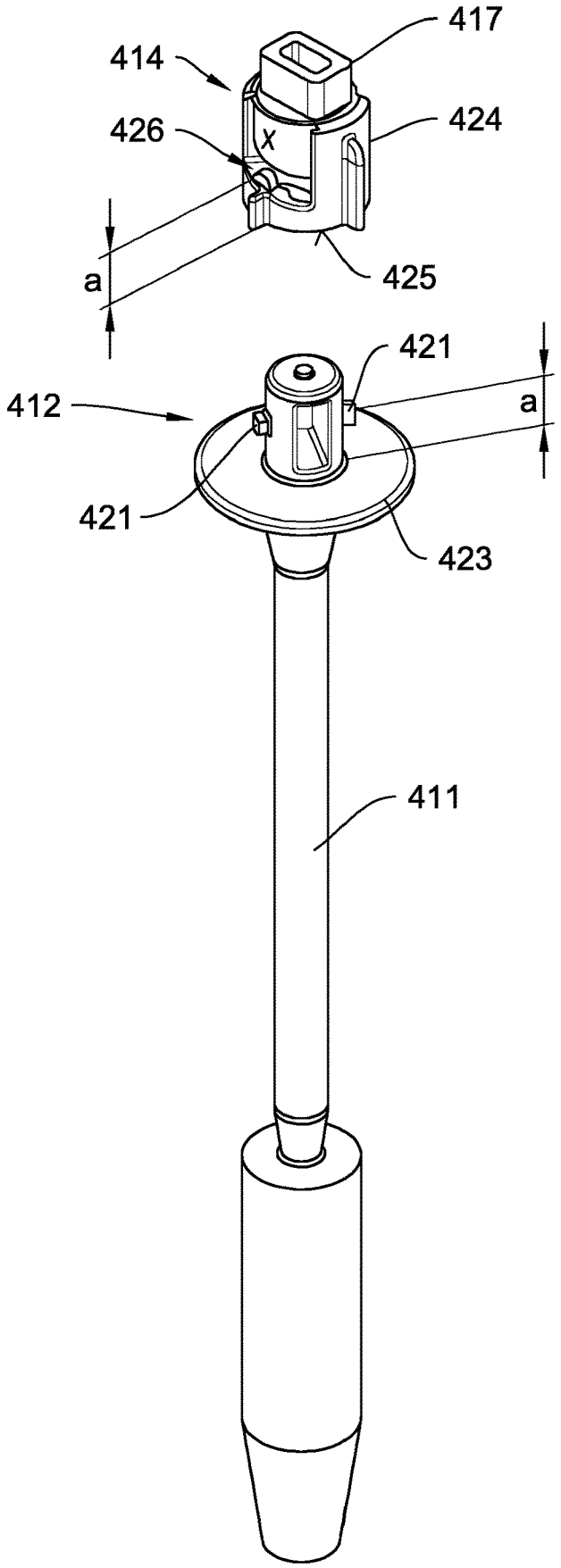
FIG. 20 shows a first isometric view of the applicator shown in FIG. 19 with an applicator holder which is separated from the applicator.

To form bayonet joint 413, joining end 412 of brush rod 411 comprises two radially protruding, diametrically opposite pins 421, which, as in particular FIG. 20 shows, are disposed at a distance a from a stop collar 423 of brush rod 411 and enable an engagement in a locking groove 426 each, which are formed in a cup wall 424 of applicator holder 414 at a distance a from a cup edge 425.

Figure 21:
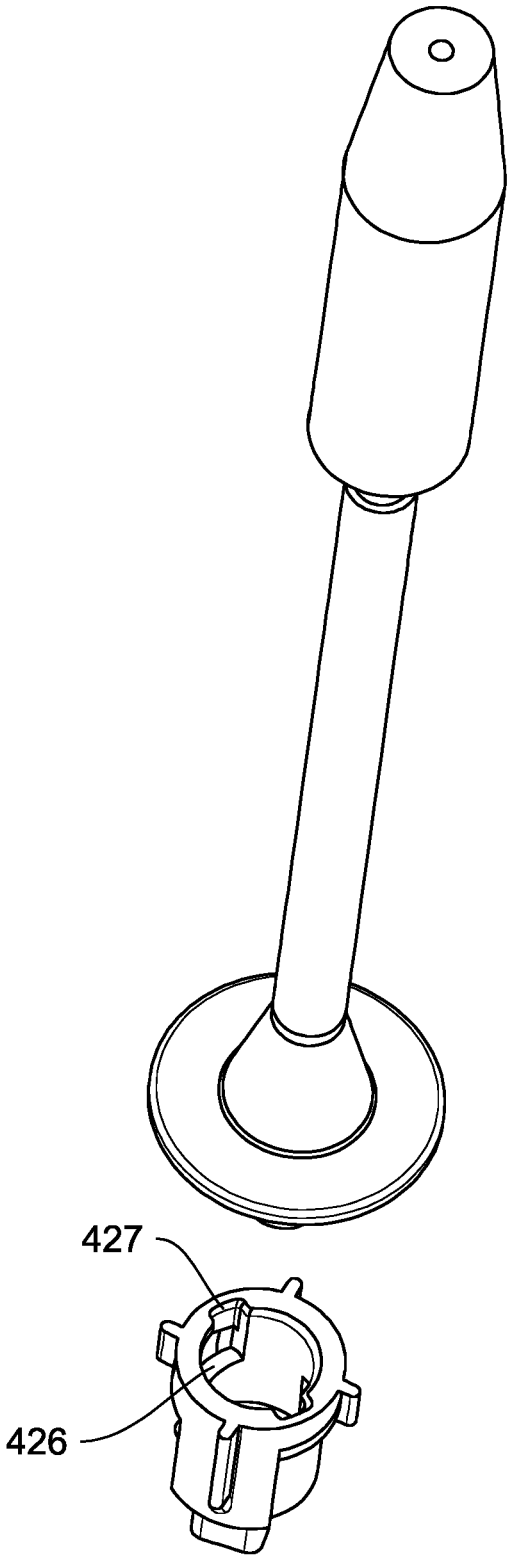
FIG. 21 shows another isometric view of the applicator holder separated from the applicator.

As FIG. 21 shows, an axially oriented insertion groove 427 is provided for each pin 421 for inserting pins 421 into locking grooves 426 in cup wall 424, such that after inserting joining end 412 into applicator holder 414 by means of an axial feed movement via a subsequent rotation of brush rod 411 around its longitudinal axis, pins 421 can be locked in locking grooves 426. For this purpose, a pretension, which secures the joining end 412 of brush rod 411 in applicator holder 414, can be produced via an embodiment of locking grooves 426, which inclines slightly in the rotational direction, with an abutment of stop collar 423 against cup edge 425.

Figure 17:
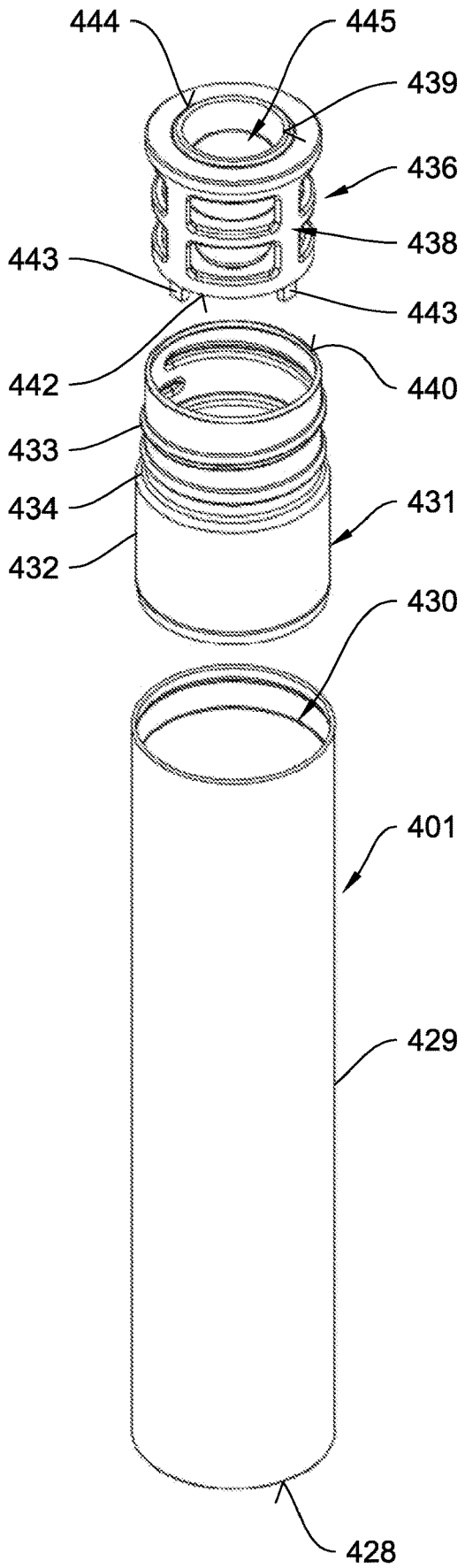
FIG. 17 shows an exploded view of a container part of the cosmetics container shown in FIG. 15.
Figure 18:
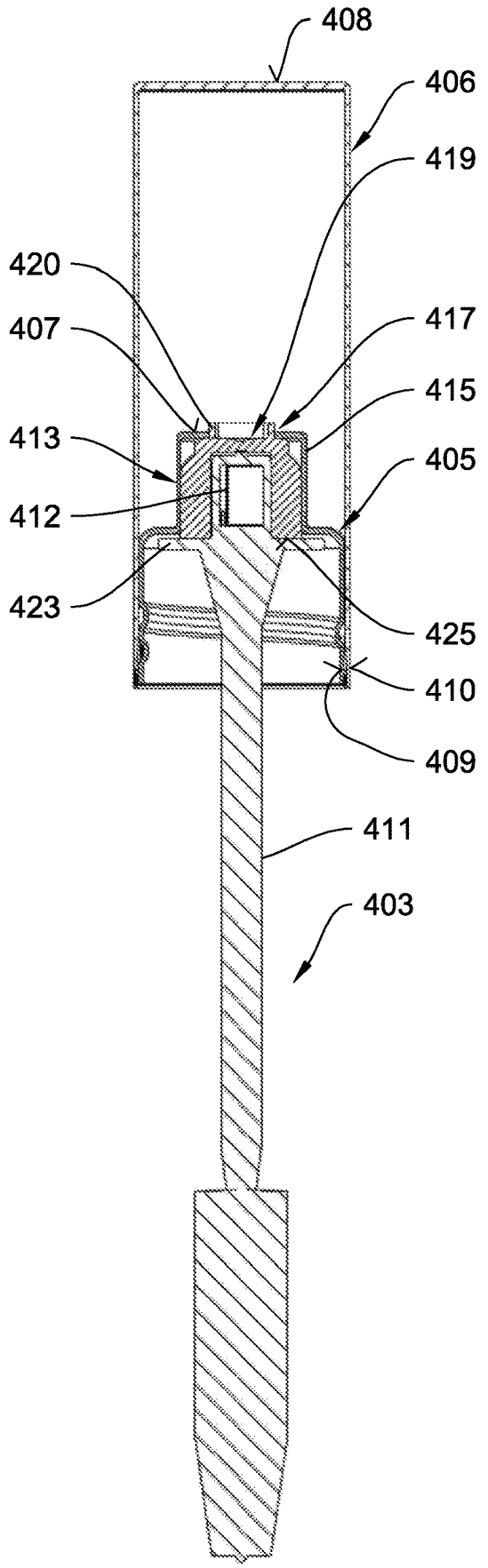
FIG. 18 shows a view of a longitudinal cut of a container cap of the cosmetics container shown in FIG. 15 while connected to an applicator.
Figure 19:
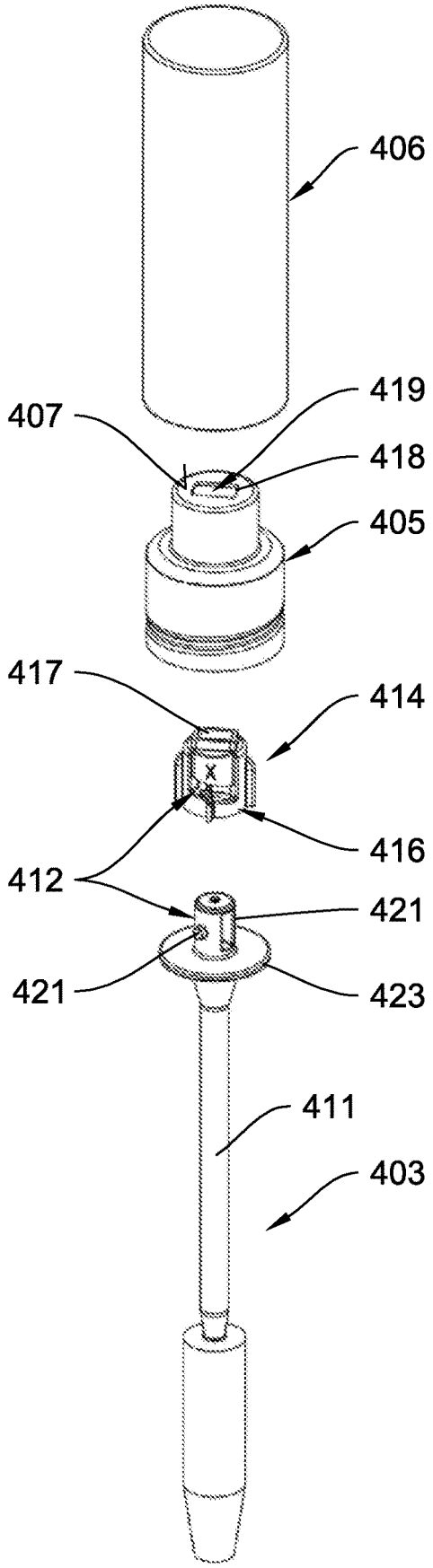
FIG. 19 shows an exploded view of the applicator shown in FIG. 18 while connected to the container cap.

As in particular FIGS. 16 and 17 show, container part 401 comprises a container body 429, which is provided with a bottom 428 and comprises a receiving opening 430 on the end opposite bottom 428 for receiving a container neck 431. A connective end 432 of container neck 431, whose outer diameter corresponds in size to the inner diameter of container body 429, is inserted into receiving opening 430 in such a manner that a shoulder 434 formed in the cross over area to a thread part 433 of container neck 431 is disposed so as to be flush with an opening edge 435 of receiving opening 430.

A wiper 436 made of plastic is inserted inn thread part 433. Wiper 436 comprises a stop collar 439 on the upper axial end of a sleeve 438, which is inserted into container neck 431, for the outer abutment against an opening edge 440 of container neck 431. Stop collar 439 limits an opening 445 using an opening edge 444, opening 445 being formed for passing brush rod 411 through wiper 414. Sleeve 438 is provided with a plurality of fastening tabs 443 on its lower axial end, the fastening tabs 443 being dispersed across the circumference of a sleeve edge 442 and which engage behind shoulder 434, which is formed on container neck 431, when deformed radially outward and after wiper 436 has been inserted into container neck 431 for fixating wiper 436 in its position in container neck 431.

The deforming process for deforming fastening tab 443 can take place corresponding to the deforming process of connective protrusion 417 on applicator holder 414 by means of an ultrasonic welding tool. For this purpose, the deforming process (which is comparable to the deforming of connective protrusion 417, which takes place before cap inner part 405 is inserted into cap outer part 406) takes place before container neck 431 is inserted into container body 429.

The invention claimed is:

1. A cosmetics container (400) comprising:

a container part (281, 321, 401), a container cap (282, 322, 402), a wiper (301, 352, 436), which is inserted into a container neck (308, 347, 431) disposed on the container part (281, 321, 401), and an applicator (283, 323, 403), which is connected to the container cap (282, 322, 402), the applicator having a brush rod passing through the wiper (301, 352, 436), the brush rod (336, 411) being provided with an applicator brush on its free end, wherein the wiper (301, 352, 436) is made of a plastic material, and wherein at least one of the container part, the container cap, the container neck, the applicator, and the brush rod is made of a material other than plastic;

wherein for separation purposes material intersections between the wiper and the at least one of the container part, the container cap, the container neck, the applicator, and the brush rod made of the material other than plastic are at least partially realized as detachable form-fit, detachable substance-to-substance or detachable force-fit connections;

wherein the container cap (282, 322, 402) comprises a cap outer part (285, 326, 406) and a cap inner part (286, 325, 405), which each comprise a sleeve part (291, 292), which are connected to each other via a press-fit connection, an adhesive connection or a welding connection;

wherein the applicator (283, 323, 403) is held in the cap inner part (286, 325, 405) by means of an applicator holder (284, 333, 414);

wherein the applicator holder (284, 333, 414) comprises a connective area (295) for being connected to the cap inner part (286, 325, 405);

wherein the applicator holder (284) comprises a joining area (296) having a sleeve-shaped joining end (297) for being connected to a joining end (298) of the brush rod; and wherein the applicator holder forms an independent physical entity.

2. The cosmetics container according to claim 1, wherein the connective area (295) is pressed into a reception area (294) of the cap inner part (286).

3. The cosmetics container according to claim 1, wherein the joining end (298) is connected to the joining area (297) by means of a clamping connection.

4. The cosmetics container according to claim 1, characterised in that the container part (281) comprises a container body (299) having the container neck (308) for receiving the wiper (301) and a container bottom (300) formed independently of the container body (299).

5. The cosmetics container according to claim 4, wherein the wiper (301) is made of an elastically deformable plastic material, such that the wiper (301) is axially fixated in the container neck (308) by two locking ridges (314, 315) each formed on an axial end of the wiper (301), one of the locking ridges (314) abutting against an opening edge (310) of a container opening (309) of the container neck (308) from the outside and the other locking ridge (315) engaging behind a container shoulder (311) formed in a cross over area from the container neck (308) to the container body (299).

6. The cosmetics container according to claim 4, wherein the container bottom (300) is cup-shaped and has a ridge-shaped expanded cross section (303), which is formed on an opening edge (310) of a cup wall, with respect to a bottom base (304), the expanded cross section (303) corresponding in size to the inner diameter of the container body (299) or being slightly larger.

7. The cosmetics container according to claim 6, wherein the container body (299) comprises a bottom opening (305) having an opening edge (307), which protrudes radially inward, the diameter of the bottom opening (305) defined by the opening edge (307) corresponding in size to the outer diameter of the bottom base (304) or being slightly larger.

8. The cosmetics container according to claim 1, wherein the container part (321) comprises a container body (345), which is provided with a bottom (344) and comprises a receiving opening (346) on its end opposite the bottom (344) for receiving the container neck (347) formed independently of the container body (345).

9. The cosmetics container according to claim 8, wherein the container neck (347) is inserted into the receiving opening (346) via a connective end (348), whose outer diameter corresponds in size to the inner diameter of the container body (345), such that a shoulder (350) is disposed so as to be flush with an opening edge (351) of the receiving opening (346) in the cross over area to a thread part (349) of the container neck (347).

10. The cosmetics container according to claim 9, wherein the wiper (352), which is made of a shape-elastic plastic, is inserted into the thread part (349) of the container neck (347), an edge web (356), which protrudes radially inward on an opening edge (351) of the thread part (349), engaging in a locking groove (355) formed on the wiper (352) and a radial edge web (356) of the wiper (352), which is formed adjacent to the locking groove (355), axially protruding over the opening edge (351).

11. The cosmetics container according to claim 1, wherein a joining end (412) of the brush rod (411) is connected to the applicator holder (414) by means of a bayonet joint (413).

12. The cosmetics container according to claim 11, wherein the applicator holder (414) comprises a cup-shaped receiving part (416), which serves for receiving the joining end (412) and has a connective protrusion (417) formed on a cup bottom, such that a projection (420) of the connective protrusion (417), which protrudes over an opening edge (418) of a receiving opening (419) formed in the cap bottom (407), engages behind the opening edge (418) after deformation in order to be connected to the cap inner part (405).

13. The cosmetics container according to claim 11, wherein the joining end (412) of the brush rod (411) comprises two radially protruding pins (421), which are disposed axially from a stop collar (423) at a distance (a) and serve for engaging in a locking groove (426) each formed in a cup wall (424) of the applicator holder (414) at the distance (a) from a cup edge (425).

14. The cosmetics container according to claim 13, wherein the stop collar (423) simultaneously serves for the sealing abutment against an opening edge (444) of an opening (445) formed for passing the brush rod (411) through the wiper (414).

15. The cosmetics container according to claim 1, wherein the wiper (414) comprises a stop collar (439) on an axial end of a sleeve (438), which is inserted in the container neck (431), for an outer abutment against an opening edge (435) of the container neck (431) and comprises several fastening tabs (443) on an opposite axial end of the sleeve (438), the fastening tabs (443) being distributed across the circumference of a sleeve edge (442) and engaging behind an inner shoulder (434) formed on a container neck (431) when deformed radially outward.

* * * * *